United States Patent [19]

Numata et al.

[11] 4,105,453

[45] Aug. 8, 1978

[54] COLORED LIGHT-SENSITIVE SILVER HALIDE PHOTOGRAPHIC MATERIAL WITH COATING ADDITIVE

[75] Inventors: Yasumasa Numata; Kunio Ito; Keiichi Mori; Yoshitami Ōno, all of Hino, Japan

[73] Assignee: Konishiroku Photo Industry Co., Ltd., Tokyo, Japan

[21] Appl. No.: 776,743

[22] Filed: Mar. 11, 1977

[30] Foreign Application Priority Data

Mar. 29, 1976 [JP] Japan ..... 51-33544

[51] Int. Cl.[2] ..... G03C 1/38; G03C 1/02; G03C 1/78; G03C 1/76

[52] U.S. Cl. ..... 96/114.5; 96/114.2; 96/87 A; 96/73

[58] Field of Search ..... 96/74, 84 A, 114.5, 96/114.2, 87 A, 73; 252/524

[56] References Cited

U.S. PATENT DOCUMENTS

| | | | |
|---|---|---|---|
| 3,254,028 | 5/1966 | Wixon | 252/524 |
| 3,415,649 | 12/1968 | Nisho et al. | 96/114.5 |
| 3,457,076 | 7/1969 | Yano et al. | 96/87 A |
| 3,547,643 | 12/1970 | Pechman | 96/87 A |
| 3,746,547 | 7/1973 | Tsuji et al. | 96/84 A |
| 3,912,517 | 10/1975 | Van Pouche et al. | 96/114.5 |

OTHER PUBLICATIONS

Surface Active Agents, Schwartz et al., pp. 46, 117, ©1949, Interscience Publ., N.Y.

Research Discl. #13146 by Lynch, p. 39, of Mar. 1975.

*Primary Examiner*—Edward C. Kimlin

*Assistant Examiner*—L. Falasco

*Attorney, Agent, or Firm*—Flynn & Frishauf

[57] ABSTRACT

A light-sensitive silver halide photographic material comprising a basic mordant, an acidic dye, a hydrophilic colloid layer containing a compound (I) and a layer containing a compound (II) which layer is adjacent to said hydrophilic layer.

8 Claims, No Drawings

COLORED LIGHT-SENSITIVE SILVER HALIDE PHOTOGRAPHIC MATERIAL WITH COATING ADDITIVE

This invention relates to a light-sensitive silver halide photographic material comprising a colored layer containing a basic mordant and an acidic dye. More particularly, this invention relates to a light-sensitive silver halide photographic material improved in coating characters of said colored layer, sharpness of images and color reproducibility.

It is known in light-sensitive silver halide color photographic materials that in order to improve sharpness of images and further color reproducibility, there are provided colored layers such as an antihalation coating, a filter layer or a backing layer. In such colored layers there are used, as coloring agents, dyes or pigments such as carbon black, colloidal silver and a manganese colloid which are incorporated into an alkali soluble resin or a hydrophilic colloid. But these coloring agents for said colored layer must be completely discolored during processing after exposure, such as developing process and have excellent light absorption and photochemical inactivity as well before the processing. Therefore, selection of coloring agents is extremely limited for the following reasons: for example, carbon black is customarily used in backing on the surface, of a base, opposite to the surface on which an emulsion layer is found. This is because it is usually black and there is no way for removing it except for removing it together with a binder; colloidal silver has defects in causing fog unfavorable to an emulsion layer because it has no sufficiently favorable light absorption nor completely photochemical inactivity; further water-soluble dyes have defects in diffusing into other adjacent layers without remaining in a colored layer to lose its effects and to cause bad effects on photographic sensitivity as well; on the other hand, in the case of use of non-diffusible dyes or organic pigments, it is often that discloloration does not occur or occurs incompletely.

From above reasons, there has recently been used a combination of a basic mordant and an acidic dye in a colored layer, which method is disclosed such as in USP 3,672,898 and Japanese laid-open publication 50-46133, etc. but several problems were pointed out there. That is, this method has defects in that some high molecular mordants and coating aids tend to cause fogs and decrease sensitivity, thus resulting in unfavorable photographic characters or disadvantages such as to deteriorate preservability of light-sensitive materials.

Especially, in case of color light-sensitive materials, they had defects in that bleaching, during processing after exposure to light, became so insufficient that desilverization became degraded. There had been found further defects in that it was difficult to completely retain dyes in colored layers on coating, so that the dyes diffused out into other adjacent layers to cause a decrease of the dye concentration in the colored layer and an insufficient absorption of light or unfavorable effects for sensitivity of emulsion layers. Further, the colored layer using, in combination, such basic high molecular mordants and acidic dyes is liable to cause coating troubles called edge bead or repellency due to bad coating characters on coating so that it is difficult to prepare an uniform coating layer without spots, especially more difficult to do so by means of multilayer coating and high speed simultaneous multi-layer coating used often recently.

This invention is intended to remove above defects.

An object of this invention is to provide light-sensitive silver halide photographic materials which are excellent in sharpness in images having a colored layer using, in combination, an excellent basic high molecular mordant and an acidic dye.

Another object of this invention is to provide light-sensitive silver halide photographic materials excellent in color reproducibility and sharpness in images.

Still another object is to provide light-sensitive silver halide photographic materials, especially light-sensitive silver halide color photographic materials which for example have a colored layer comprising a basic mordant and an acidic dye, the colored layer being coated uniformly and spotlessly by multi-layer coating and high speed simultaneous multilayer coating without causing coating troubles called as edge bead or repellency.

Above objects and other objects described below of this invention are obtained by providing, by coating, a hydrophilic colloid layer comprising at least a basic mordant, an acidic dye and a compound having formula (I) and a layer adjacent to said hydrophilic colloid layer containing a compound having formula (II) as a constituent layer of the light-sensitive silver halide photographic material:

Formula (I):

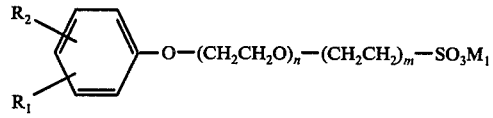

wherein $R_1$ and $R_2$ each represent hydrogen, alkyl having 1 to 18 carbon atoms or phenyl which may be substituted and preferably at least one of $R_1$ and $R_2$ is alkyl and the combined carbon number of alkyl in $R_1$ and $R_2$ is 5 to 12; $M_1$ represents a cation; n represents 1 to 20; and m represents zero or 1.

Formula (II):

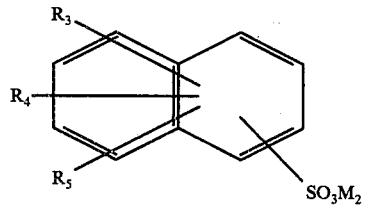

wherein $R_3$, $R_4$ and $R_5$ individually represent hydrogen or alkyl having 1 to 12 carbon atoms provided that the combined carbon number of $R_3$, $R_4$ and $R_5$ is not more than 18 and each of $R_3$, $R_4$ and $R_5$ is preferably straight or branched alkyl of not more than 5 carbon atoms and $M_2$ represents a cation.

In the formulas, the cations for $M_1$ and $M_2$ are, for example, alkali metal cations such as sodium or potassium ions, ammonium ions; lower alkyl substituted ammonium ions; or hydroxy alkyl substituted ions. As to the substituents for the substituted group in $R_1$ and $R_2$ in formula (I) alkyl or aryl such as phenyl is preferred. Such phenyl may further be substituted with alkyl.

Representative compounds having formula (I) used in this invention are as follows:

I - 1 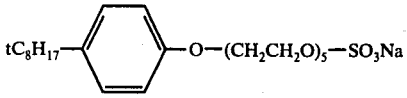

I - 2 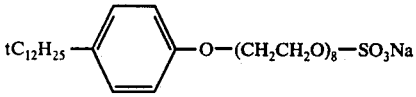

I - 3 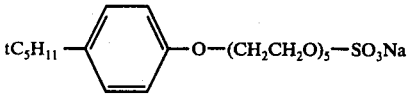

I - 4 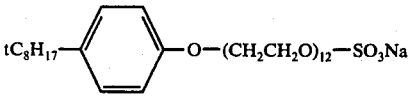

I - 5 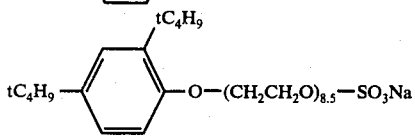

I - 6 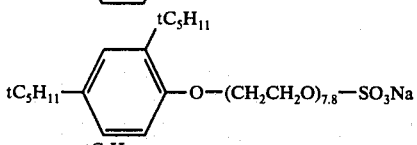

I - 7 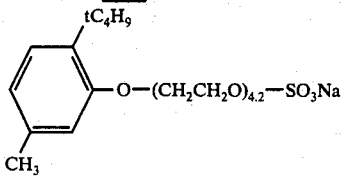

I - 8 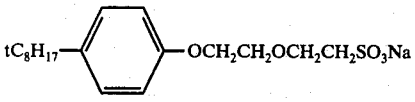

I - 9 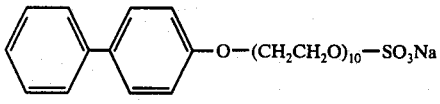

I - 10 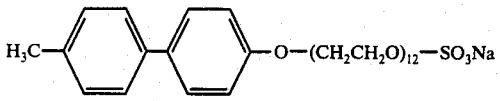

I - 11 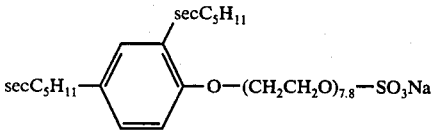

I - 12 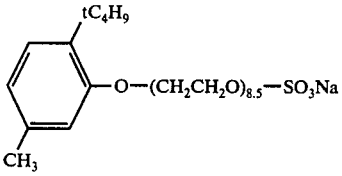

I - 13 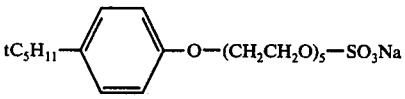

The compounds having formula (I) used in this invention are marketed, for example, in tradename of Triton-X200 and Triton-X301 from Rohm and Haas Co. and Nissan Trax H-45 from Nippon Oil and Fats Co., Ltd.

Next, representative compounds having formula (II) used in this invention are as follows:

II - 1 Sodium di-n-butyl naphthalene sulfonate
II - 2 Sodium di-tert-butyl naphthalene sulfonate
II - 3 Sodium di-isopropyl naphthalene sulfonate
II - 4 Sodium tri-isopropyl naphthalene sulfonate
II - 5 Sodium di-n-propyl naphthalene sulfonate
II - 6 Sodium tri-n-propyl naphthalene sulfonate
II - 7 Sodium di-tert-amyl naphthalene sulfonate Compounds having formula (II) used in this invention are marketed, for example, in tradename of Alkanol Xc from E. I. du Pont de Nemours and Co., Pelex NB from Kao Soap Co., Ltd., Nekalit from Miyoshi Oil and Fat Co., Ltd., Neoate P from Tokai Seiu Co. and Leopol BX from Takemoto Oil and Fat Co., Ltd.

A hydrophilic colloid layer containing a basic mordant, an acidic dye and a compound having formula (II) according to this invention may be any layer which constitutes a light-sensitive silver halide photographic material but is generally an antihalation layer, a filter layer or an intermediate layer when said photographic material is for color photography. If necessary, it may be an emulsion layer. Also, a requisite to the layer containing a compound having formula (II) is that it is coated as a layer adjacent to said hydrophilic colloid layer but especially in the case of the simultaneous multi-layer coating most favorable results can be obtained when a compound having formula (II) is incorporated into an adjacent layer which is coated at the same time when said hydrophilic colloid layer is coated, especially when the adjacent layer is on a base side of said hydrophilic colloid layer. That is, in case said hydrophilic colloid layer is provided by coating as a constituent layer of a light-sensitive silver halide photographic material, when a compound having formula (II) is incorporated into a base side layer adjacent to said hydrophilic colloid layer, said hydrophilic colloid layer can be obtained uniformly and spotlessly even by high speed multi-coating and light-sensitive silver halide photographic materials excellent in sharpness of image and, in case of color photographic materials, further with excellent color reproducibility can be obtained. Therefore, the layer containing a compound having formula (II) may be any layer which constitutes a light-sensitive silver halide photographic material and is adjacent to a hydrophilic colloid layer containing a basic mordant, an acidic dye and a compound having formula (I), for example, an emulsion layer.

In case both said adjacent layer and said hydrophilic colloid layer are coated repeatedly in this order by double layer coating in order to form not less than four layers, it is especially preferred that a first combination of the adjacent layer and the hydrophilic colloid layer is simultaneously coated on a base, the surface or surfaces of which may have been undercoated to be hydrophilic or treated to be so by other means, and then dried. Thereafter a second combination of the adjacent layer and the hydrophilic colloid layer is simultaneously coated on the surface of the dried first hydrophilic layer placed on the first adjacent layer. This procedure may be repeated. In this case, the first adjacent layer may be different from the second. The same may be true as to the hydrophilic layers. Also the adjacent layers may be photosensitive emulsions.

An addition amount of a compound having formula (I) used in this invention is not limited but is usually from 0.05 to 50 g, preferably 0.1 to 5 g, per 1 kg of a coating liquid for said hydrophilic colloid layer in which this compound is incorporated. In the above coating liquid, a nonionic surface active agent can be used in combination with the compound and especially a combination use of the compound with saponin, polyoxyethylene alkyl ether or polyoxyethylene-alkylphenol ether is favorable.

On the other hand, an addition amount of a compound having formula (II) is not limited and is usually from 0.05 to 50 g, preferably 0.1 to 5 g, per 1 kg of a coating liquid for the adjacent layer.

In case these compounds of formula (I) are incorporated into the coating liquids, the compound may be used in a water-soluble solvent such as water or methanol and other alternative methods known can be used.

The compound having formula (II) may be incorporated into the coating liquid therefor in the same way as is compound (I) but the following methods may be applied: there has been known an incorporation method in which fat-soluble or hydrophobic additives such as couplers, ultraviolet ray absorbents and stain inhibitors are dispersed using a surface active agent and incorporated into various coating liquids constituting light-sensitive materials, so a compound having formula (II) may be used as such as the surface active agent, so that the compound is present in the layers obtained from the coating liquid and may be incorporated into an emulsion layer or other hydrophilic colloid layer in the shape of a dispersed liquid of said fat-soluble or hydrophobic additives.

A binder used in a hydrophilic colloid layer containing a basic mordant, an acidic dye and a compound having formula (I) and a binder used in a layer adjacent to said hydrophilic layer containing a compound having formula (II) according to this invention are preferably gelatin but according to the desired objects other hydrophilic binders can be incorporated. Suitable binders as such hydrophilic binders are gelatin derivatives, polyvinyl compounds, cellulose derivatives, polyacrylamides, polysaccharides, water-soluble synthetic high-molecular compounds and water-insoluble synthetic high-molecular compounds. Also, polyalkyl acrylate, polyvinyl alcohol, copolymer of vinylalcohol and vinylcyanoacetate, casein acetate, polyvinyl pyrrolidone, polyvinyl imidazole, polyvinyl lactam, polyacrylic acids or polymethacrylic acids can be incorporated.

Basic mordants used for this invention are preferably high molecular mordants having a basic group(s), for example, a polymer containing imidazole, pyridine, alkylaminoalkyl (metha)acrylate or their quarternary salts or aminoguanidine. Preferred basic mordants used for this invention are disclosed in USPs 2,548,564, 2,675,316, 2,882,156 and 3,706,503. Among these basic mordants, most preferred ones which are disclosed in USP 2,882,156 and 3,706,563 are condensed products of a polyvinyl alkylketone or a poly-N-oxoalkyl(metha)acrylamide and an aminoguanidine.

Preferred basic mordants used for this invention are exemplified as follows:

Mordent - 1

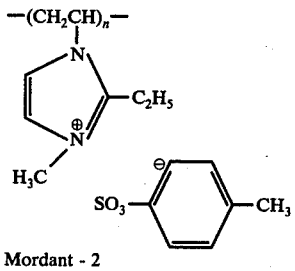

n = 500

Mordant - 2

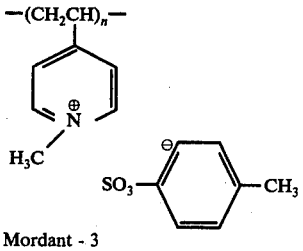

n = 500

Mordant - 3

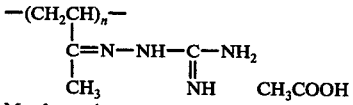

n = 300

Mordant - 4

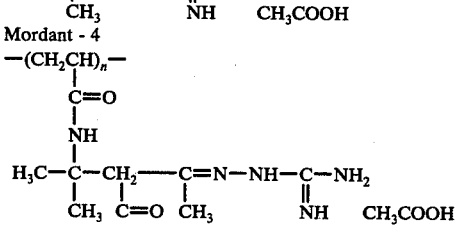

n = 300

Any acidic dyes can be used for this invention, but acidic dyes having sulfonyl or carboxyl groups, which are for example acidic dyes such as those of azo type, triphenylmethane type, anthraquinone type, styryle type, benzylidene type, merocyanine type or oxonol type are preferred.

Representative acidic dyes used for this invention are exemplified as follows:

Dye - 1

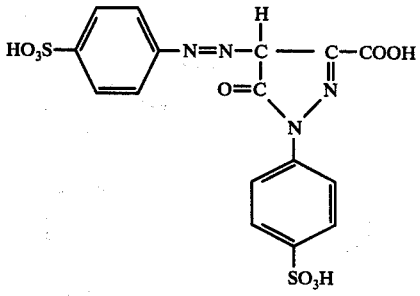

Dye - 2

-continued
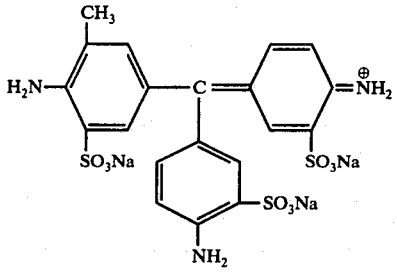
Dye - 3
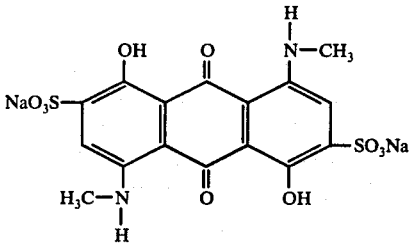
Dye - 4
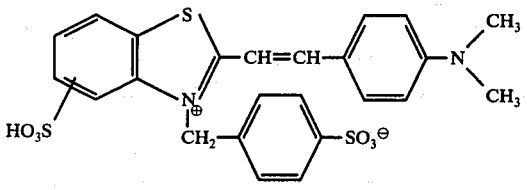
Dye - 5
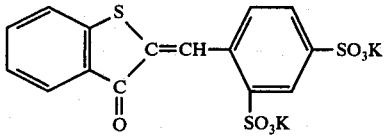
Dye - 6
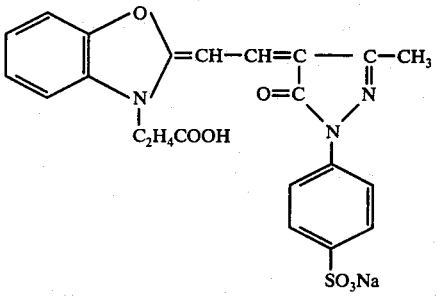
Dye - 7
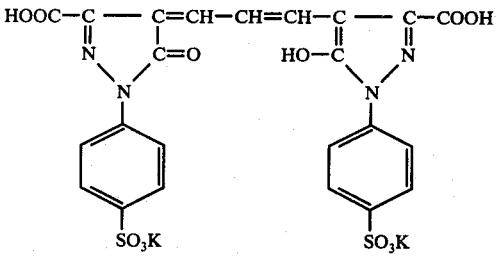
Dye - 8
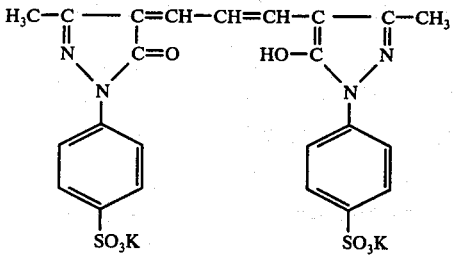

-continued

Dye - 9

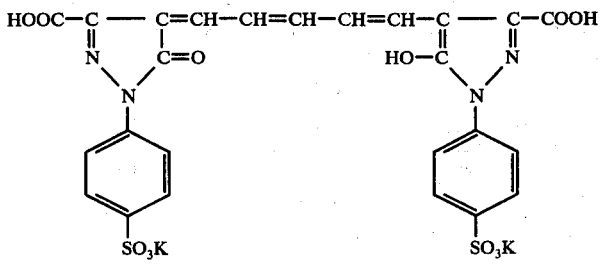

Into light-sensitive silver halide photographic materials, used for this invention, comprising a hydrophilic layer containing a basic mordant, an acidic dye and a compound having formula (I) and a layer adjacent to said hydrophilic colloid layer containing a compound having formula (II), other photographic additives may be incorporated.

As hardeners which may be optionally incorporated, various hardeners such as aldehyde type, epoxy type, ethyleneimine type, active halogen, vinylsulfone type, isocyanate type, sulfonate ester type, carbodiimide type, mucochloric acid type and acryloyl type hardeners can be used.

Anti-foggants or stabilizers which may be optionally incorporated are, for example, imidazole type, oxazole type, thiazole type, triazole type, tetrazole type, mercapto type and azaindene type compounds. Wetting agents are, for example, dihydroalkanes. Agents for improving physical characters of layers are preferred to be, for example, high molecular substances, in fine particles, having water-dispersibility which substances are obtained by emulsion polymerization and such as a copolymer of alkyl acrylate or alkyl methacrylate and an acrylic or methacrylilic acid, copolymer and styrene and a maleic acid and a half ester of a styrene-maleic anhydride copolymer. Agents for improving desilverization are preferably vinylalcohol, vinylpyrrolidone or a polymer of these derivatives.

As other photographic additives, there may optionally be used gelatin plasticizers, ultraviolet ray absorbents, pH regulators, antioxidants, antistatic agents, viscosity improvers, granularity improvers, brightness improvers, development speed regulators and/or matting agents.

Light-sensitive silver halide photographic materials of this invention may preferably be used for color but in this case it is preferred to incorporate couplers for cyan, magenta and yellow dye formation into the silver halide photographic emulsion. As couplers of this object, phenols, 5-pyrazolones and ketomethylene derivatives are effective. These couplers may be preferably used in combination with an active-point-substitution type coupler, colored coupler and development inhibitor releasing coupler.

Any silver halide photographic emulsion used for light-sensitive silver halide photographic materials in this invention may be used according to application purpose and any kind of silver halides such as silver chloride, silver iodide, silver bromide, silver iodobromide, silver chloroiodide, and silver chloroiodobromide may be used as light-sensitive components. Further, these silver halide photographic emulsions may chemically be sensitized with noble metal sensitizers such as noble metal salts of ruthenium, rhodium, palladium, iridium, platinum and gold, and noble metal complex salts such as ammonium chloropalladate, potassium chloroplatinate, potassium chloropalladite and potassium chloroaurate; sulfur sensitizers such as sulfur compounds; reduction sensitizers such as stannous salts and polyamines; and/or sensitizers such as polyalkylene oxide.

Optical sensitizers which may be optionally added to the light-sensitive silver halide photographic emulsions of this invention may be cyanines, mero cyanines, tri- or tetra-nucleic mero cyanines, tri or tetra-nucleic cyanines, styryls, holopolarcyanines, hemicyanines, oxonols and hemioxonols and these optical sensitizers are preferred to be a nitrogen containing heterocyclic nucleus such as a basic group of e.g. thiazole or thiazolines; and/or rhodanines, thiohydantoines, oxazolidinediones, barbituric acid, thiobarbituric acid and/or pyrazolones as a part of their structure and these nuclei may be substituted with an alkyl, hydroxylalkyl, halogen, phenyl, cyano and alkoxyl group and may be condensed with an aliphatic or heterocyclic ring.

Further, gelatin may be preferably used as a hydrophilic colloid for the silver halide photographic emulsion of this invention, but according to needs other hydrophilic binders may be incorporated. Preferred binders as such hydrophilic binders are gelatin derivatives and others described before.

Any base may be used as bases of the light-sensitive silver halide photographic material of this invention but representative bases are polyethylene terephthalate film, poly carbonate film, cellulose acetate film, glass, baryta paper and polyethylene laminate paper, which may be optionally undercoated.

Basic mordants, acidic dyes and compounds of formula (I) according to this invention are preferably incorporated into an antihalation layer, an intermediate layer, or a filter layer usually. However, in certain case, they may be added into a silver halide emulsion layer. Those layers may be for color photosensitive films and color photographic papers. However, they may also be hydrophilic colloid layers of various light-sensitive silver halide photographic materials for general black and white, X-ray, direct positive, printing and infrared use and in case of microfilm they may be an antihalation layer made between a base and an emulsion layer to obtain a microfilm having extremely excellent resolving power.

For coating a hydrophilic layer containing a basic mordant, an acid dye and a compound having formula (I) and a layer containing a compound having formula (II) adjacent to said hydrophilic layer of this invention with other light-sensitive silver halide photographic material constituting layers on said base, usual liquid coating methods, for example, a dip method dipping a coating roller, a bead method using a slide hopper, a curtain method dropping coating liquids in curtain shape, etc. are used. Especially this invention can be carried out effectively in light-sensitive silver halide photographic materials prepared by simultaneous multicoating as described before. In this case, it is desired that, into the outer most layer of coatings, a basic mordant, an acidic dye and a compound of formula (I) according to this invention are incorporated and a compound having formula (II) is incorporated on a layer which is adjacent to said layer and coated simultaneously with it. At this coating, better coating characters can be obtained in case the surface tension of the outer layer is made lower than that of the inner layer.

This invention will be explained in detail by examples but these are not intended to limit the scope of this invention.

EXAMPLE - 1

On an undercoated triacetylcellulose film, a first layer coating liquid and a second layer coating liquid having such composition as set forth below were coated at the same time and in multilayer using a slide hopper in dried layer thicknesses of 3.5 $\mu$ and 0.8 $\mu$ respectively, so that the second layer was on the first layer superposed on the film. This procedure was repeated to obtain Samples A to J.

First layer coating liquid:

Into 1 kg of a green sensitive silver iodobromide gelatin emulsion (silver amount: 0.35 mol./kg of emulsion) containing 4 mol. % of silver iodide, 100 ml of 0.5% solution of 4-hydroxy-6-methyl-1,3,3a,7-tetrazaindene and 200 ml of 0.5% solution of 1,3,-triacryloylhexahydro-s-triazine were added. In the meantime, a mixture of 36 g of magenta coupler used in the fifth layer of Example 2 described later, 10 g of tricresylphosphate and 108 g of ethylacetate was well mixed with 300 ml of 10 % gelatin solution and then 60 ml of 5% aqueous solution of such a compound as listed in Table 1 for the first layer was further added thereinto. Thereafter the resulting mixture was added to said emulsion to obtain a desirable emulsified and dispersed coating liquid.

Second layer coating liquid:

Into 600 ml of 5% gelatin solution was added 60 ml of 5% aqueous solution of Mordant-4 and then 150 ml of 1% aqueous solution of Dye-1 with stirring. Further, 100 ml of 2% aqueous solution of such a compound as listed in Table - 1 for the second layer and 40 ml of 5% aqueous solution of polyvinylpyrrolydone (polymerization degree 90) were added to the above solution to obtain a desired second layer coating liquid.

So-called repellency numbers and wetting rate of the samples obtained were measured.

The obtained results are shown in Table - 1.

Table 1

| Sample | Compound added to First layer coating liquid | | Compound added to Second layer coating liquid | | Repellency Number (per $m^2$) | Wetting rate* (%) |
|---|---|---|---|---|---|---|
| A | Compound | II - 2 | Compound | I - I | 0 | 100 |
| B | Compound | II - 2 | Compound | I - 5 | 0 | 100 |
| C | Compound | II - 4 | Compound | I - 1 | 0 | 100 |
| D | Compound | II - 4 | Compound | I - 5 | 0 | 100 |
| E | Compound | II - 2 | Comparative compound | - 1 | 38 | 93 |
| F | Compound | II - 2 | Comparative compound | - 2 | 12 | 97 |
| G | Comparative compound | - 1 | Comparative compound | - 1 | 45 | 89 |
| H | Comparative compound | - 1 | Comparative compound | - 2 | 15 | 92 |
| I | Comparative compound | - 1 | Compound | I - 1 | 4 | 100 |
| J | Comparative compound | - 1 | Compound | I - 5 | 5 | 100 |

*Wetting rate: relative ratio of the width of an actual coating when the width of a coating expected to be coated is assumed as 100.

Comparative compounds used in the above experiments are as follows:

Comparative compound - 1:

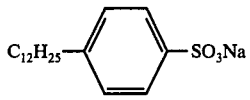

Comparative compound - 2:

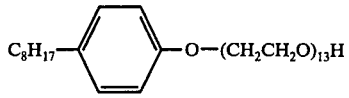

The results of Table - 1 show that in case of Samples A to D according to this invention both the repellency number and wetting rate obtained are excellent in comparison with samples (E to J) obtained by combination of other compounds and also indicate the excellent coating characters of this invention.

Also the same test as in Example - 1 was carried out except that Mordant - 3 and Dye - 5 were used instead of Mordant - 4 and Dye - 1 respectively, in the second layer coating liquid in Example - 1. The obtained results were the same as in Table - 1.

EXAMPLE - 2

On an undercoated triacetylcellulose film, first and second layer coating liquids have compositions set forth below were coated at the same time and in multilayer using a slide hopper in dried layer thicknesses of 3 $\mu$ and 0.8 $\mu$ respectively, so that the second layer was on the first layer superposed on the film.

First layer coating liquid:

This liquid was prepared by adding 1 g of compound II - 2 to 1 kg of 3% gelatin solution containing 3 g of black colloid silver.

Second layer coating liquid:

Into 600 ml of 5% gelatin solution, 60 ml of 5% aqueous solution of Mordant - 4 and then, with stirring, 150 ml of 1% aqueous solution of Dye - 9, 100 ml of 2% aqueous solution of compound I - 1 and 40 ml of 5% aqueous solution of polyvinylpyrrolidone (polymerization degree 90) were added to obtain this liquid.

Next, on the above coated and dried samples, a third and fourth layer coating liquids having the following compositions were coated at the same time and in multilayer in this order using a slide hopper in a dried layer thickness of 3.5 μ and 0.8 μ, respectively:

Third layer coating liquid:

Into 1 kg of a red-sensitive silver iodobromide gelatin emulsion (silver amount: 0.35 mol/kg of emulsion) containing 4 mol % of silver iodide were added 100 ml of 0.5% solution of 4-hydroxy-6-methyl-1,3,3*a*,7-tetrazaindene and 200 ml of 0.5% solution of 1,3,5-triacryloyl-hexahydro-s-triazine and an emulsified and dispersed liquid obtained by adding a mixed solution of 20 g of a cyan coupler, 10 g of tricresylphosphate and 60 g of ethyl acetate to a solution obtained by adding 40 ml of 5% aqueous solution of compound II - 2 to 200 g of 10% gelatin solution was added to the above liquid to obtain the intended liquid:

Fourth layer coating liquid:

This liquid was prepared in the same way as in the second layer coating liquid of Example 1 except that Dye - 7 was used instead of Dye - 1 and that compound I was employed as the compound of formula (I).

Next, on the above coated and dried sample fifth and sixth layer coating liquids having the following compositions were coated and dried at the same time and in multilayer in this order in dried layer thicknesses of 3.5 μ and 0.8 μ, respectively:

Fifth layer coating liquid:

Into 1 kg of a green-sensitive silver iodobromide gelatin emulsion (silver amount: 0.35 mol/kg of emulsion) containing 4 mole. % of silver iodide were added 100 ml of 0.5% solution of 4-hydroxy-6-methyl-1,3,3a,7-tetrazaindene and 200 ml of 0.5% solution of 1,3,5-triacryloyl-hexahydro-s-triazine and an emulsified and dispersed liquid which was obtained by adding a mixed solution of 36 g of a magenta coupler, 10 g of tricresylphosphate and 108 g of ethyl acetate into a solution obtained by adding 60 ml of 5% aqueous solution of Compound II - 2 to 300 ml of 10% gelatin solution was added to the above liquid to obtain the desired liquid:

Sixth layer coating solution:

This liquid was prepared in the same way as in the forth layer coating liquid of the above-mentioned forth layer except that Dye - 6 was used instead of Dye - 7.

Next, on the above samples, seventh and eighth layer liquids having the following compositions were coated and dried at the same time and in multilayer in this order in dried layer thicknesses of 3.5 μ and 0.8 μ, respectively to obtain Sample K:

Seventh layer coating liquid:

Into 1 kg of a green-sensitive silver iodobromode gelatin emulsion (silver amount: 0.35 mol/kg of emulsion) containing 4 mol % of silver iodide were added 100 ml of 0.5% solution of 4-hydroxy-6-methyl-1,3,3a,7-tetrazaindene and 200 ml of 0.5% solution of 1,3,5-triacryloyl-hexahydro-s-triazine and an emulsified and dispersed solution which was obtained by adding a mixed solution of 80 g of a yellow coupler, 20 g of dibutyl phthalate and 244 g of ethyl acetate to a solution obtained by adding 130 ml of 5% solution of compound II-2 into 600 ml of 10% gelatin solution was added to the above liquid to obtain the desired liquid:

Eighth layer coating liquid:

A 5% gelatin solution containing compound I-1.

On the other hand, Sample L was prepared by the same method as in Sample K except that the mordant and dye used in the second and fourth layers were removed in Sample K. Also, Sample M was prepared by the same method as in Sample L except that 1 g of yellow colloid silver was used instead of the mordant and dye in the sixth layer.

The following couplers and sensitizing dye were used in each of said samples:

In the third layer:

Coupler

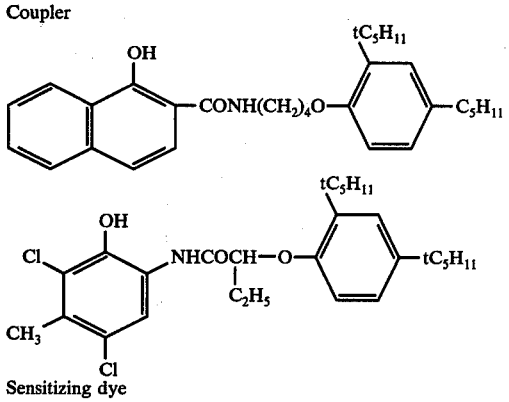

Sensitizing dye

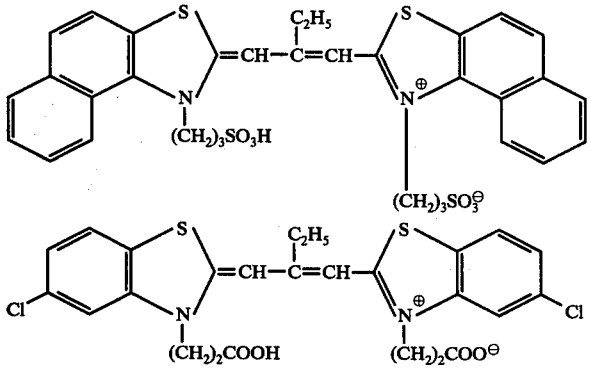

-continued
In the fifth layer:
Coupler
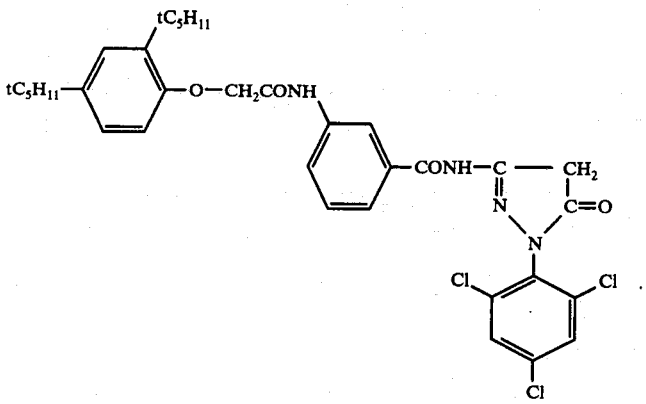
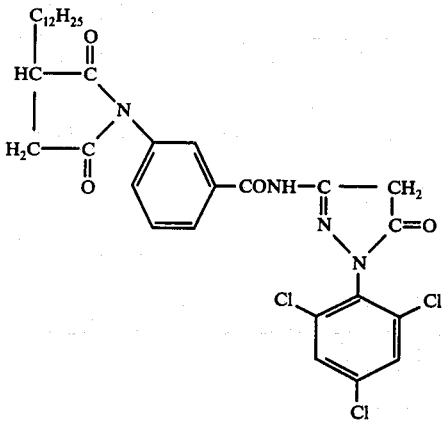
Sensitizing dye
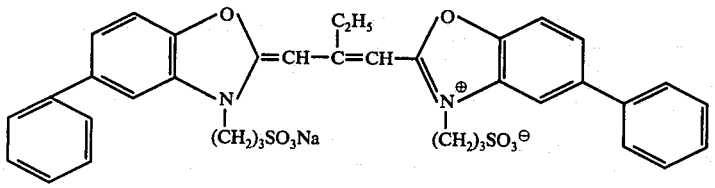
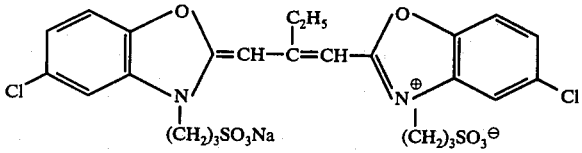
In the seventh layer:
Coupler
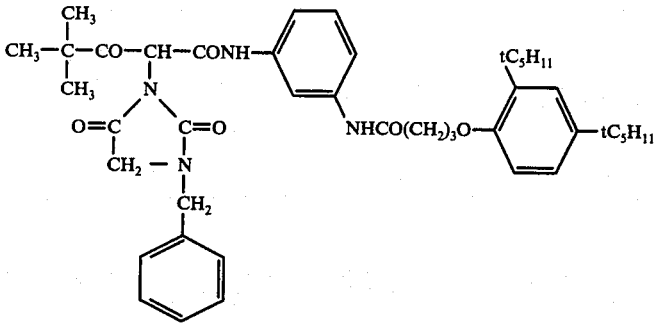

-continued

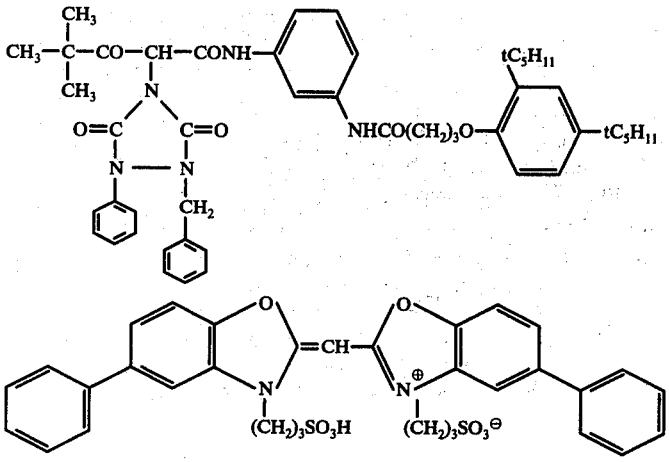

The obtained samples were exposed to light using a sine wave test chart by means of a method disclosed in Jounal of Society of Motion-Picture and Television Engineers (J. SMPTE), 69,p 151 - 156 and 239 - 249 (1960) and then processed in the following order by a color reversal development method and the revolving power of each of samples were measured. The results obtained are listed in Table - 2.

Treating processes and compositions of treating liquids are as follows:

| | | |
|---|---|---|
| Treating processes (52° C) | | |
| First development | 1 min. | |
| Stopping | 30 sec. | |
| Water washing | 30 sec. | |
| Color development | 2 min. | |
| Stopping | 30 sec. | |
| Water washing | 30 sec. | |
| Bleaching | 1 min. | |
| Bleach-neutralization | 30 sec. | |
| Fixing | 1 min. | |
| Water washing | 1 min. | |
| Then, dried | | |
| First developing solution | | |
| Sodium polyphosphate | 2.0 | g |
| Sodium sulfite | 44 | g |
| Phenidone | 0.6 | g |
| Hydroquinone | 5.5 | g |
| Potassium thiocyanate | 1.4 | g |
| Sodium bromide | 1.3 | g |
| Potassium iodide (1% aqueous solution) | 1.3 | ml |
| Potassium hydroxide (45 % aqueous solution) | 8.8 | ml |
| Boric acid | 10 | g |
| Water to make | 1 | l |
| Stopping solution | | |
| Glacial acetic acid | 30 | ml |
| Sodium hydroxide | 1.5 | g |
| Water to make | 1 | l |
| Color developing solution | | |
| Sodium polyphosphate | 5 | g |
| Benzylalcohol | 4.5 | ml |
| Sodium sulfite | 7.5 | g |
| Sodium phosphate | 35 | g |
| Sodium bromide | 1 | g |
| Potassium iodide (1% aqueous solution) | 9 | ml |
| Sodium hydroxide | 3.2 | g |
| Citraginic acid | 1.5 | g |
| 4-Amino-N-ethyl-N-[β-methane-sulfonamidoethyl]-m-toluidine | 10 | g |
| Ethylenediamine | 3 | g |
| Tertiary butylamineborane | 0.07 | g |
| Water to make | 1 | l |
| Bleaching solution | | |
| Ferrichloride | 200 | g |
| Water to make | 1 | l |
| Bleach-neutralization solution | | |
| Glacial acetic acid | 20 | ml |
| Sodium citrate | 45 | g |
| Water to make | 1 | l |
| Fixing solution | | |

-continued

| | | |
|---|---|---|
| Ammonium thiosulfate | 100 | g |
| Ammonium sulfite | 15 | g |
| Water to make | 1 | l |

Table 2

| Sample | Resolving power (numbers/mm) |
|---|---|
| K | 120 |
| L | 100 |
| M | 90 |

Table - 2 shows that Samples K and L according to this invention have excellent resolving power in comparison with Comparative sample (Sample M).

Samples K and L also had excellent color reproducibility without decreasing their sensitivity.

What is claimed is:

1. In a light-sensitive silver halide photographic material which comprises a hydrophilic colloid layer containing a basic mordant and an acidic dye and an adjacent layer thereto, the improvement which comprises a hydrophilic colloid layer containing a compound having the following formula (I) and the adjacent layer containing a compound having the following formula (II):

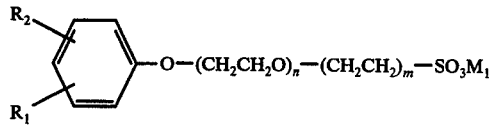

(I)

wherein $R_1$ and $R_2$ each represent hydrogen, alkyl having 1 to 18 carbon atoms or phenyl which may be substituted; *n* represents 1 to 20; *m* represents zero or 1; and $M_1$ represents a cation;

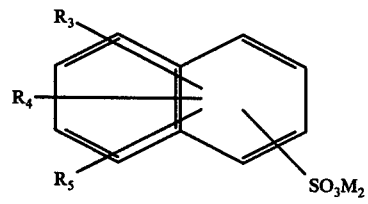

(II)

wherein $R_3$, $R_4$ and $R_5$ each represent hydrogen, alkyl having 1 to 12 carbon atoms, provided that the combined carbon number of $R_3$, $R_4$ and $R_5$ is not more than 18; and $M_2$ represents a cation.

2. A light-sensitive silver halide photographic material as claimed in claim 1 wherein the light-sensitive silver halide photographic material is a light-sensitive silver halide color photographic material.

3. A light-sensitive silver halide photographic material as claimed in claim 1 wherein at least one of $R_1$ and $R_2$ in formula (I) is alkyl and the combined number of carbon atoms of alkyl in $R_1$ and $R_2$ is 5 to 12.

4. A light-sensitive silver halide photographic material as claimed in claim 1 wherein the compound having formula (I) is a compound selected from the group consisting of I-1, I-2, I-3, I-4, I-5, I-6, I-7, I-8, I-9, I-10, I-11, I-12 and I-13.

5. A light-sensitive silver halide photographic material as claimed in claim 1 wherein the compound having formula (II) is a compound selected from the group consisting of II-1, II-2, II-3, II-4, II-5, II-6 and II-7.

6. A light-sensitive silver halide photographic material as claimed in claim 1 wherein the hydrophilic colloid layer is on the adjacent layer.

7. A light-sensitive silver halide photographic material as claimed in claims 1 wherein each of $R_3$, $R_4$ and $R_5$ in formula (II) is straight or branched alkyl having not more than five carbon atoms.

8. A light-sensitive silver halide photographic material as claimed in claim 7 wherein at least one of $R_1$ and $R_2$ in formula (I) is alkyl and the combined number of carbon atoms of alkyl in $R_1$ and $R_2$ is 5 to 12.

* * * * *